US012687172B2

(12) United States Patent
Huang et al.

(10) Patent No.: US 12,687,172 B2
(45) Date of Patent: Jul. 21, 2026

(54) BUILT-IN ELECTRIC AIR PUMP

(71) Applicant: BESTWAY INFLATABLES & MATERIAL CORP., Shanghai (CN)

(72) Inventors: Shuiyong Huang, Shanghai (CN); Xianglin Zeng, Shanghai (CN); Qingshui Song, Shanghai (CN); Wanbin Qiu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 629 days.

(21) Appl. No.: 17/889,681

(22) Filed: Aug. 17, 2022

(65) Prior Publication Data

US 2023/0304502 A1 Sep. 28, 2023

(30) Foreign Application Priority Data

Mar. 23, 2022 (CN) ..... 202220670591.3

(51) Int. Cl.
*F04D 25/06* (2006.01)
*F04D 29/42* (2006.01)

(52) U.S. Cl.
CPC ..... *F04D 25/068* (2013.01); *F04D 25/0693* (2013.01); *F04D 29/4206* (2013.01)

(58) Field of Classification Search
CPC ..... F04D 25/068; F04D 25/0693; F04D 29/4206; F04D 29/503; F04D 29/601; F04D 25/084
See application file for complete search history.

(56) References Cited

U.S. PATENT DOCUMENTS 11,668,310 B2 * 6/2023 Huang ..... F04D 29/4246 417/242
2010/0247355 A1 * 9/2010 Pan ..... F04D 25/084 417/423.14

(Continued)

FOREIGN PATENT DOCUMENTS

| | | |
|---|---|---|
| CN | 201176943 | 1/2009 |
| CN | 211623775 | 10/2020 |
| EP | 3754192 | 12/2020 |

OTHER PUBLICATIONS

Extended European Search Report dated May 19, 2023 (May 19, 2023), 55 pages, issued on related European patent application 22189395.1 by the European Patent Office.

*Primary Examiner* — Essama Omgba
*Assistant Examiner* — Lilya Pekarskaya
(74) *Attorney, Agent, or Firm* — Dickinson Wright PLLC

(57) ABSTRACT

A built-in electric air pump, adapted to be attached to an inflatable body, is provided. The built-in electric air pump includes a pump housing defining therein an accommodating cavity; a pump cover and a switching device disposed in the accommodating cavity; an air valve in fluid communication with the switching device; and an operating switch operably connected to the switching device. The operating switch is configured to drive the switching device to switch between a first position in which the pump is in an inflation state and a second position in which the pump is in an exhaust state. The built-in electric air pump further comprises a press-fit element, disposed in the accommodating cavity and including a first end biased to press against the first limiting structure, and a second end biased to press against the pump housing, such that the press-fit element and the pump housing limit a position of the pump cover in the accommodating cavity.

15 Claims, 15 Drawing Sheets

(56) References Cited

U.S. PATENT DOCUMENTS

| | | | | |
|---|---|---|---|---|
| 2010/0247356 | A1* | 9/2010 | Tsai | F04D 29/602<br>417/423.14 |
| 2011/0180169 | A1* | 7/2011 | Song | A47C 27/082<br>137/861 |
| 2012/0093662 | A1* | 4/2012 | Tsai | F04D 27/008<br>417/44.2 |
| 2013/0230410 | A1* | 9/2013 | Tsai | A47C 27/083<br>417/32 |
| 2016/0215780 | A1 | 7/2016 | Liu | |
| 2017/0191483 | A1* | 7/2017 | Liu | F16K 5/0414 |
| 2018/0335042 | A1* | 11/2018 | Lin | F04D 27/004 |
| 2019/0072099 | A1* | 3/2019 | Li | F04D 29/701 |
| 2019/0211829 | A1* | 7/2019 | Huang | F04D 25/166 |
| 2019/0383398 | A1* | 12/2019 | Hamilton | F16J 15/3448 |
| 2020/0256345 | A1* | 8/2020 | Huang | F04D 29/503 |
| 2020/0386235 | A1* | 12/2020 | Huang | F04D 29/503 |

* cited by examiner

BUILT-IN ELECTRIC AIR PUMP

CROSS-REFERENCE TO RELATED APPLICATION

This Application claims priority from Chinese Application CN202220670591.3 filed Mar. 23, 2022 in China, the disclosure of which is incorporated herein by reference in its entirety.

BACKGROUND

1. Field

Apparatuses and methods consistent with example embodiments relate to the field of electric air pumps, and specifically to a built-in electric air pump.

2. Description of the Related Art

An inflatable product such as an inflatable mattress or an inflatable sofa usually requires an electric air pump to inflate the inflatable product or to pump air out of the inflatable product. For ease of use, some inflatable products are equipped with a built-in electric air pump. The body portion of such a built-in electric air pump may be located within the inflation chamber of the inflatable product, and during operation, the electric air pump pumps air from the outside and fills the air into the inflation chamber or sucks air from the inflation chamber and exhausts the air to the outside.

A control unit, an actuator, and other components of an electric air pump are assembled into a housing of the electric air pump. Most accessories inside a conventional built-in electric air pump are fixed by screws, resulting in complex assembly procedures and relatively low production efficiency.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an electric air pump, adapted to be attached to an inflatable body, comprises: a pump housing defining therewithin an accommodating cavity; a pump cover disposed within the accommodating cavity; a switching device disposed within the accommodating cavity; an air valve in fluid communication with the switching device; and an operating switch operably connected to the switching device and configured to drive the switching device to switch between a first position in which the built-in electric air pump is in an inflation state and a second position in which the built-in electric air pump is in an exhaust state; and a press-fit element disposed within the accommodating cavity and comprising a first end biased to press against a first limiting structure of the pump cover, and a second end biased to press against the pump housing, such that the press-fit element and the pump housing limit a position of the pump cover within the accommodating cavity.

The built-in electric air pump may further comprise: an impeller disposed on a first side of the pump cover, opposite the first side; and a motor disposed on a second side of the pump cover, opposite the first side, the motor configured to drive the impeller; wherein the switching device is accommodated within the pump cover.

The pump cover may comprise: a switching cover and an impeller cover in fluid communication with the switching cover, wherein the switching device is accommodated within the switching cover, the impeller is accommodated within the impeller cover, and the first limiting structure is disposed on the impeller cover.

The first limiting structure may be shaped to fit the first end of the press-fit element.

The pump cover may comprise a motor positioning post configured to engage the motor, and the press-fit element comprises a pressing portion corresponding to the motor and biased to press the motor against the pump cover.

The operating switch may be mounted on the pump housing by means of snap-fit.

The air valve may comprise a valve cover mounted on the pump housing by means of snap-fit.

The press-fit element may comprise at least one of a press plate and a press rod.

The press-fit element may comprise a press plate; the press plate divides the accommodating cavity into a first chamber and a second chamber independent of each other, wherein the driving device and the switching device are accommodated within the first chamber, and the second chamber is configured to accommodate an external power cable therewithin; and the press plate comprises a wiring groove configured to enable the external power cable to be connected to the driving device.

The pump housing may comprise a shell having an opening therein and a panel configured to close the opening in the shell, such that the shell and the panel together define the accommodating cavity; and the panel comprises a panel body corresponding to the first chamber, and a flip cover corresponding to the second chamber, wherein the flip cover is pivotably attached to the panel body and comprises a buckle element configured to engage with the shell.

The shell may further comprise a second limiting structure provided on an inner wall thereof and in contact with a lateral side of the press plate, such that the second limiting structure limits a position of the press plate within the accommodating cavity.

The driving device may further comprise a micro switch, and the pump cover further comprises a switch positioning post and a switch buckle, wherein the micro switch is engaged with the switch positioning post, and the switch buckle is configured to retain the engagement between the micro switch and the switch positioning post.

One of the pump cover and the switching device may comprise a guide groove formed therein and extending obliquely relative to an axis of the switching device, and another one of the pump cover and the switching device may comprise a guide block is provided on the other of the pump cover and the switching device; and when the switching device rotates around the axis of the switching device, the guide block slides along the guide groove thereby forcing the switching device to move within the pump cover in an axial direction of the switching device.

When the switching device is in one of the first position and the second position, the switching device may drive the air valve to be opened; and when the switching device is in a third position, the air valve may be closed.

The built-in electric air pump may further comprise: a switching cover accommodating the switching device therein; wherein the air valve comprises: a valve stem, a valve head disposed on an end of the valve stem, and a return spring comprising a first end which abuts against the pump housing and a second end which abuts against the valve head, wherein the switching device comprises a pusher; wherein when the switching device moves in an axial direction of the switching cover to one of the first position and the second position, the pusher applies a force to the valve head to drive the air valve to be opened; and when the switching device moves in the axial direction of the switching cover to the third position, the return spring drives the air valve to be closed.

The switching device may comprise, formed in a wall surface thereof, an upper opening and a lower opening which are separated by the pusher; the pump cover may comprise a first opening formed therein at the first position of the switching device, such that an inflation path is formed between the upper opening and the lower opening; the pump cover may further a second opening formed therein at the second position of the switching device, such that an exhaust path is formed between the lower opening and the upper opening; and when the switching device is in the third position, the upper opening and the lower opening are blocked by the pump cover.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
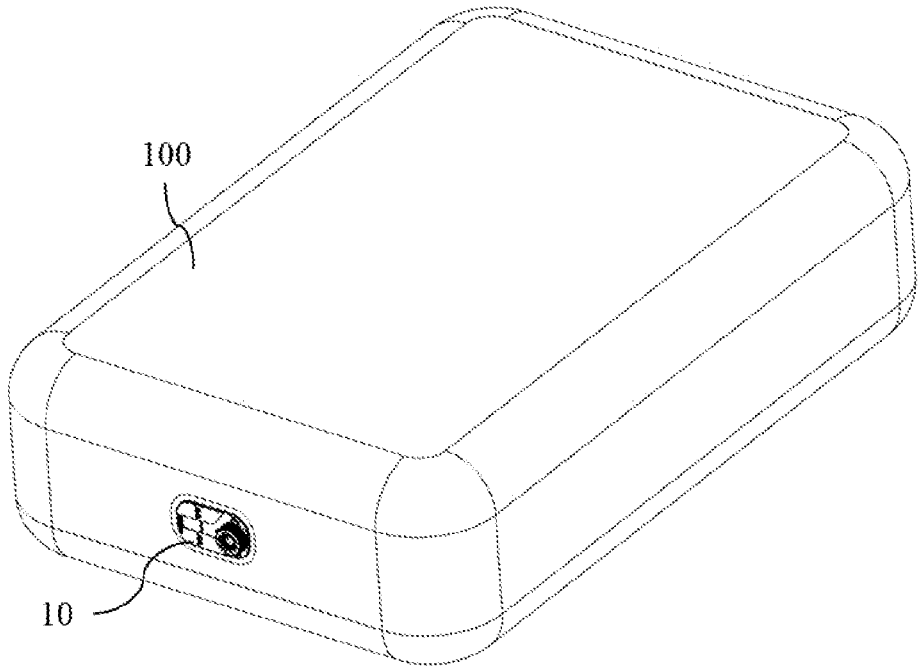
FIG. 1 is a schematic diagram of an inflatable product provided with a built-in electric air pump according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

In this description, the expressions such as "inner," "outer," etc., which are used for explaining structural positions of various components, are not absolute but relative. The orientation expressions are appropriate when the various components are arranged as shown in the figures, but should change accordingly when the positions of the various components in the figures change.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

As shown in FIG. 1, a built-in electric air pump 10 according to an example embodiment is adapted to be attached to an inflatable body 100, for example, an inflatable mattress. A body part of the built-in electric air pump 10 is located in an inflation chamber of the inflatable body 100. An operating switch is fitted on a wall of the inflation chamber. A user operates the operating switch to enable the electric air pump to suck air from the outside and fill the air into the inflation chamber or enable the electric air pump to suck air from the inflation chamber and exhaust the air to the external atmospheric environment. It should be understood that the inflatable body 100 may alternately be a product such as inflatable furniture (for example, an inflatable sofa), an inflatable toy, an inflatable pool, or another inflatable structure as would be understood in the art.

Figure 2:
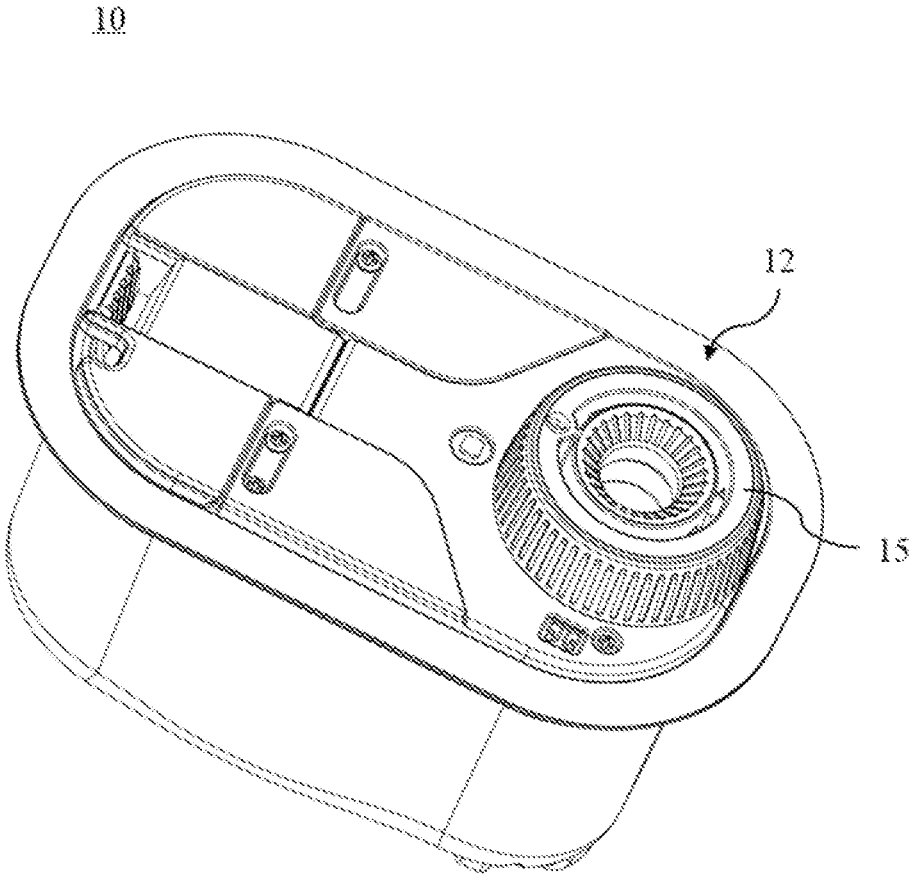
FIG. 2 is a schematic perspective view of a built-in electric air pump according to an example embodiment.
Figure 3:
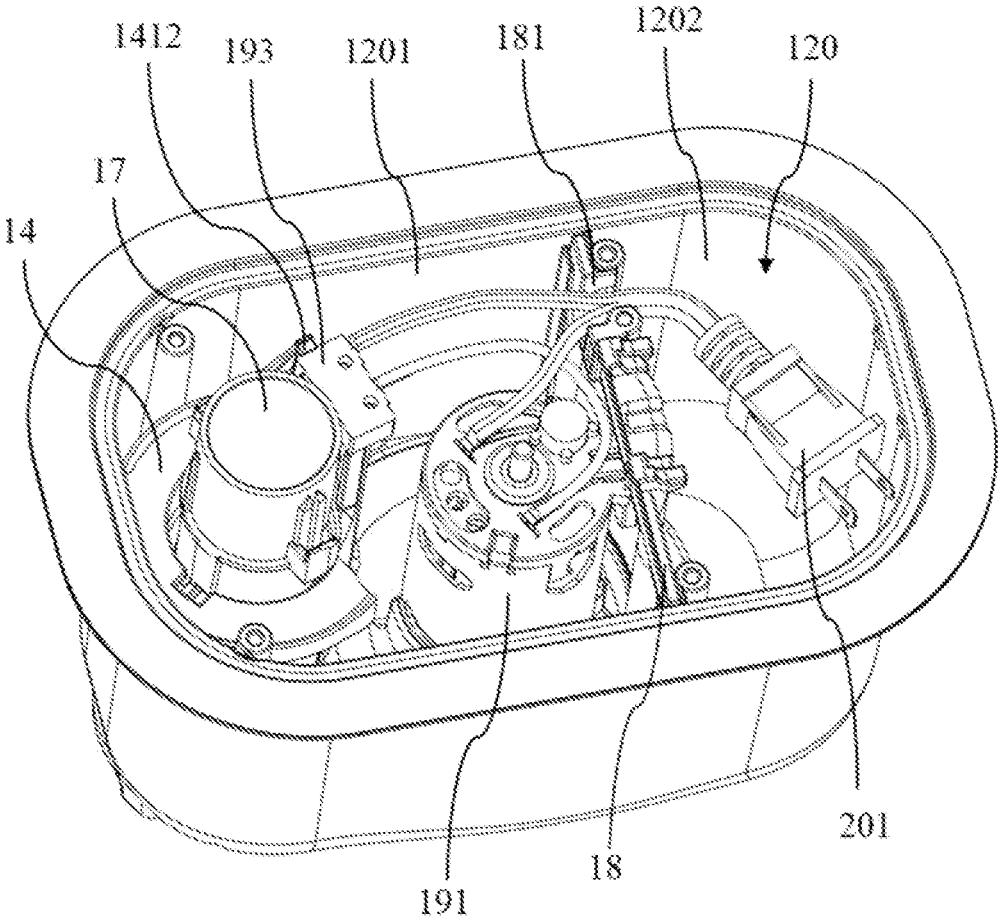
FIG. 3 is a schematic perspective diagram of the pump of FIG. 2 with part of the pump housing hidden to show the internal structures within the pump housing.
Figure 4:
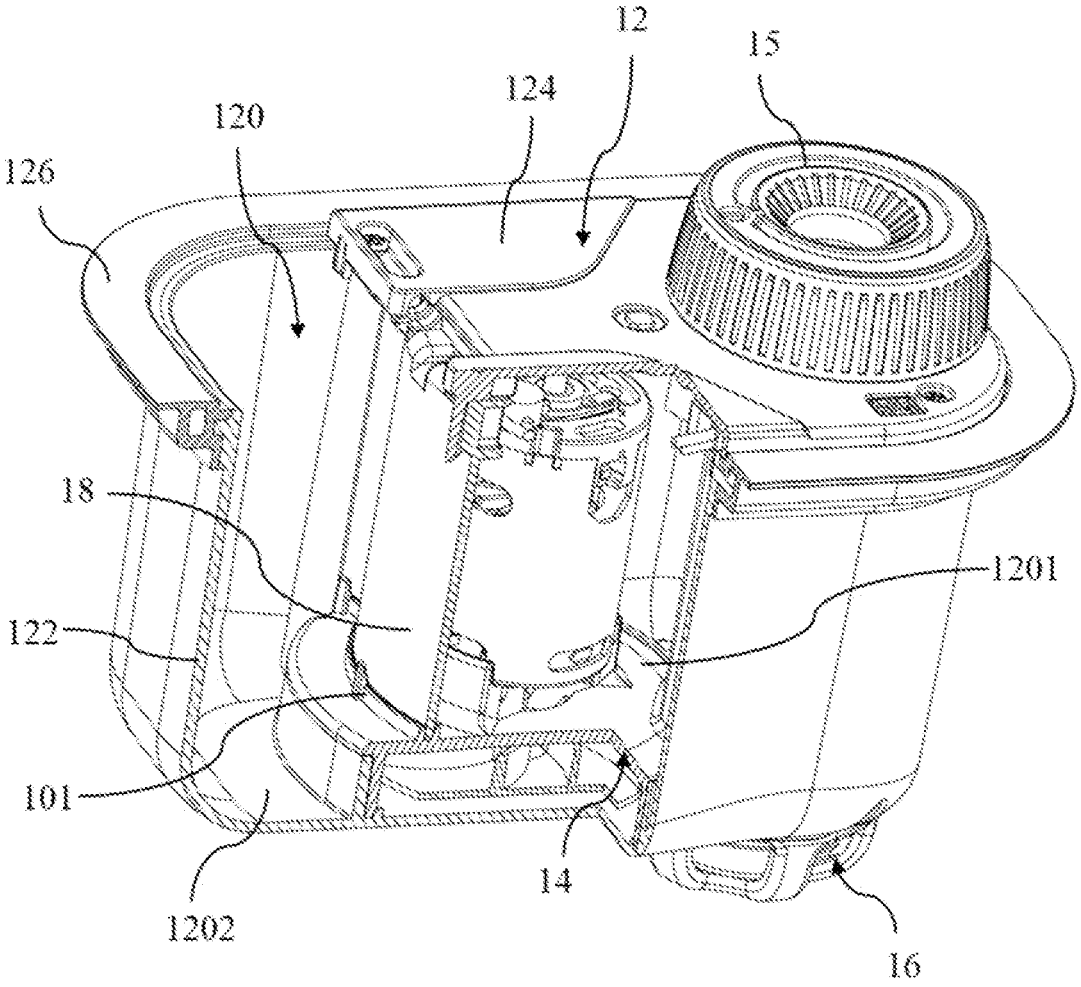
FIG. 4 is another schematic perspective diagram of the pump housing of FIG. 2 with part of the pump housing hidden, to show further internal structures within the pump housing.

With reference to FIGS. 2-4, the built-in electric air pump 10 comprises a pump housing 12 and a pump cover 14, and further comprises an operating switch 15 and an air valve 16. The pump housing 12 defines an accommodating cavity 120, and the accommodating cavity 120 accommodates the pump cover 14 and a switching device 17. The switching device 17 is in fluid communication with the air valve 16, and is configured to be driven by the operating switch 15 to switch between at least a first position and a second position. Specifically, when the switching device 17 is in a first position, the built-in electric air pump 10 is in an inflation state. When the switching device 17 is in a second position, the built-in electric air pump 10 is in an exhaust state. In other words, the position of the switching device 17 is changed under the action of the operating switch 15, and the operation status of the built-in electric air pump 10 changes according to the change in the position of the switching device 17.

According to one or more example embodiments, the built-in electric air pump 10 further comprises a press-fit element 18. Referring to FIG. 4, the pump cover 14 is provided with a first limiting structure 101. One end of the press-fit element 18 presses against the first limiting structure 101, and the other end of the press-fit element 18 presses against the pump housing 12, so that the press-fit element 18 and the pump housing 12 limit a position of the pump cover 14 within the accommodating cavity 120. With the orientation shown in FIG. 4 as a reference, the pump cover 14 is placed at a bottom of the pump housing 12, in the accommodating cavity 120. A top end of the press-fit element 18 is pressed by the top of the pump housing 12. A bottom end of the press-fit element 18 presses against the first limiting structure 101 to press the pump cover 14 against the bottom of the pump housing 12. In other words, the press-fit element 18 extends the distance between the pump cover 14 and the top of the pump housing 12. The pump cover 14 is fixed in the accommodating cavity 120 without fasteners such as a screw or a bolt. The press-fit element 18 allows components such as the pump cover to be firmly fixed in the pump housing 12. Compared with use of screws to fix a component in an electric air pump, it is unnecessary to specially reserve mounting positions for screws. For example, it is unnecessary to respectively arrange screw posts and screw holes in two members to be connected to each other, the screw holes configured for screws to pass through and then be screwed into the screw post to lock the two members. Accordingly, an operating space for an assembly person to tighten screws is also saved, which reduces materials for manufacturing the electric air pump and reduces the weight and size of the product.

Figure 5:
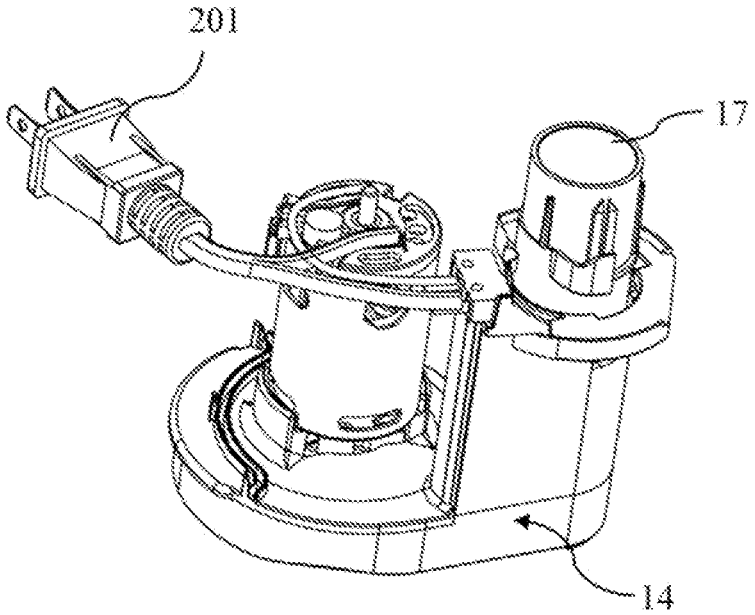
FIG. 5 is a schematic diagram of internal structures within the pump housing of FIG. 2.
Figure 6:
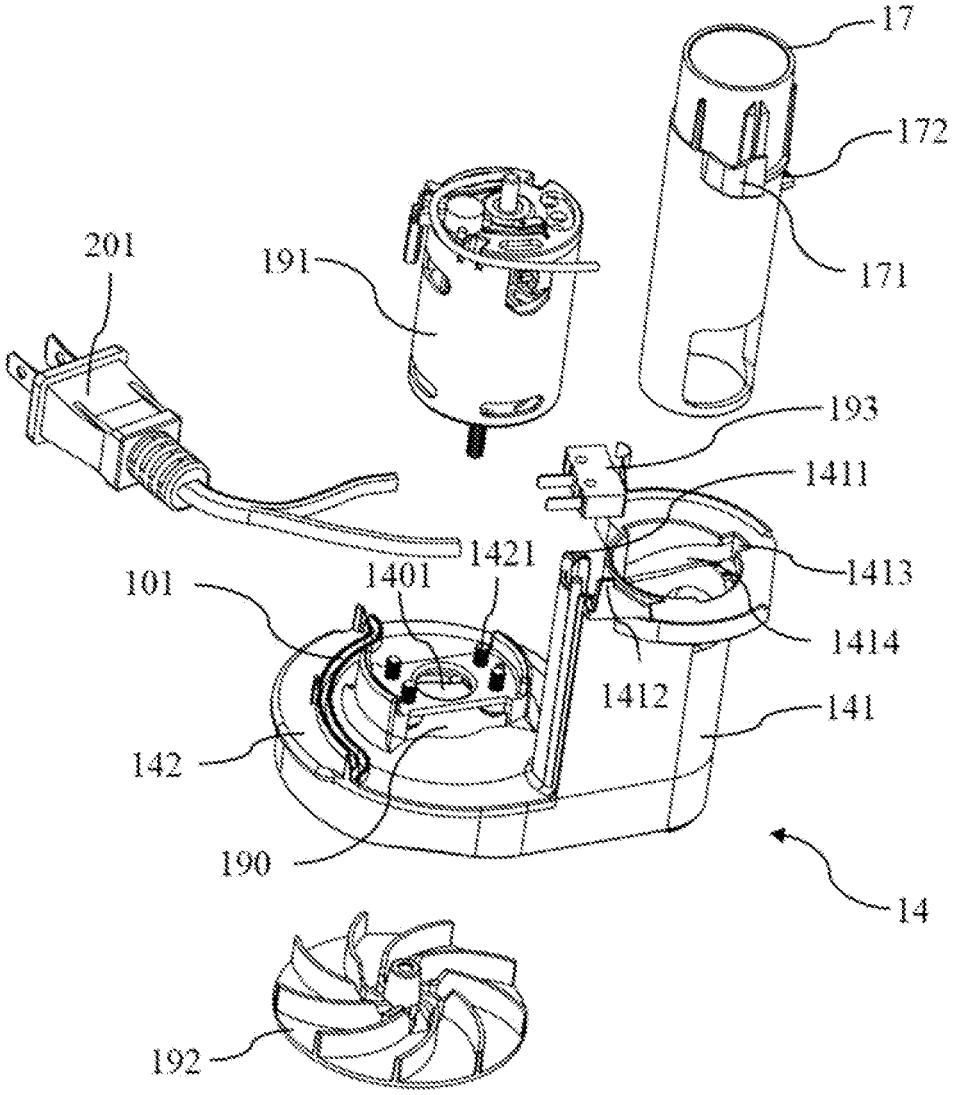
FIG. 6 is a schematic exploded view of FIG. 5.

It should be understood that the built-in electric air pump 10 further comprises a driving device configured to control airflow directions inside and outside the built-in electric air pump 10. According to one or more example embodiments, referring to FIGS. 5 and 6, the driving device comprises a motor 191 and an impeller 192. The motor 191 and the impeller 192 are respectively located on opposite sides of the pump cover 14. The impeller 192 is configured to be driven by the motor 191. Specifically, a connecting hole 1401 is provided in the pump cover 14 to enable operable connection between the motor 191 and the impeller 192. An output shaft of the motor 191 passes through the connecting hole 1401 to be connected to the impeller 192. The pump cover 14 is further provided with a through hole 190. The through hole 190 enables fluid communication between a side of the pump cover 14 on which the motor 191 is located and a side of the pump cover 14 on which the impeller 192 is located. Referring to FIGS. 5 and 6, the pump cover 14 further accommodates the switching device 17. The pump cover 14 is accommodated in the accommodating cavity 120, so that the switching device 17 is also accommodated in the accommodating cavity 120.

According to one or more example embodiments, the pump cover 14 comprises a switching cover 141 and an impeller cover 142. The switching cover 141 is in fluid communication with the impeller cover 142. Specifically, the switching device 17 is accommodated in the switching cover 141. The impeller 192 is accommodated in the impeller cover 142. The impeller 192 is driven by the motor 191 to rotate within the impeller cover 142 to generate an airflow. With reference to FIG. 6, the impeller cover 142 is in fluid communication with the switching cover 141 at a position near the switching cover 141, so that the direction of an airflow from the impeller 192 can be changed by the switching cover 141.

The switching cover 141 and the impeller cover 142 may be provided as one piece. The press-fit element 18 presses against the impeller cover 142 to position the pump cover 14. Alternatively, the switching cover 141 and the impeller cover 142 may be separately manufactured and then connected together. The press-fit element 18 presses against the impeller cover 142. The impeller cover 142 limits the position of the switching cover 141, so that the press-fit element 18 positions the pump cover 14. The first limiting structure 101 for engaging the press-fit element 18 may be disposed on the impeller cover 142. Additionally, the first limiting structure 101 may be adapted to an end of the press-fit element 18. For example, the first limiting structure 101 may be configured to be a curved positioning groove adapted to the bottom of the press-fit element 18.

According to one or more example embodiments, the motor may be mounted and fixed by fasteners such as a screw or a bolt. As shown in FIG. 6, the impeller cover 142 of the pump cover 14 is provided with a motor positioning post 1421 for engaging with the motor 191. The motor positioning post 1421 and the first limiting structure 101 are disposed on one side of the impeller cover 142, and the impeller 192 is disposed on the other opposite side of the impeller cover 142. Further, the press-fit element 18 is provided with a pressing portion (not shown) that corresponds to the motor 191 and that abuts the motor 191 against the pump cover 14. Specifically, with the orientation shown in FIG. 6 as a reference, a positioning hole is provided at the bottom of the motor 191. Before the press-fit element 18 is mounted to the first limiting structure 101, the motor 191 is positioned by means of an engagement between the positioning hole of the motor and the motor positioning post 1421. Thereafter, the press-fit element 18 is mounted. The motor 191 is pressed on the motor positioning post 1421 to be fixed via the pressing portion of the press-fit element 18 with no fastener being used, thereby further simplifying the mounting procedures for the built-in electric air pump 10. Optionally, the press-fit element 18 may be provided with the foregoing pressing portion at a level corresponding to the top of the motor 191.

According to one or more example embodiments, referring to FIG. 4, the pump housing 12 comprises a shell 122 and a panel 124. The shell 122 comprises an opening for mounting internal components such as the pump cover 14, the switching device 17, and the driving device in the pump housing 12. The panel 124 closes the opening, so that the shell 122 and the panel 124 define the foregoing accommodating cavity 120. The pump housing 12 further comprises an inflatable body attachment portion 126. The inflatable body attachment portion 126 may be made of the same material as a wall of the inflatable body, for example, polyvinyl chloride (PVC). The inflatable body attachment portion 126 may attach (for example, weld) the shell 122 together with the entire pump housing 12 to the wall of the inflatable body by means of a form-fit with an edge of the shell 122, so that most of the pump housing 12 is disposed in the inflation chamber of the inflatable body, and the panel 124 is exposed from the inflatable body to allow the operating switch 15, mounted on the panel, to be accessible.

In addition to simplifying the mounting procedures for the internal components of the built-in electric air pump 10, one or more example embodiments may provide convenient mounting of external components.

Figure 7A:
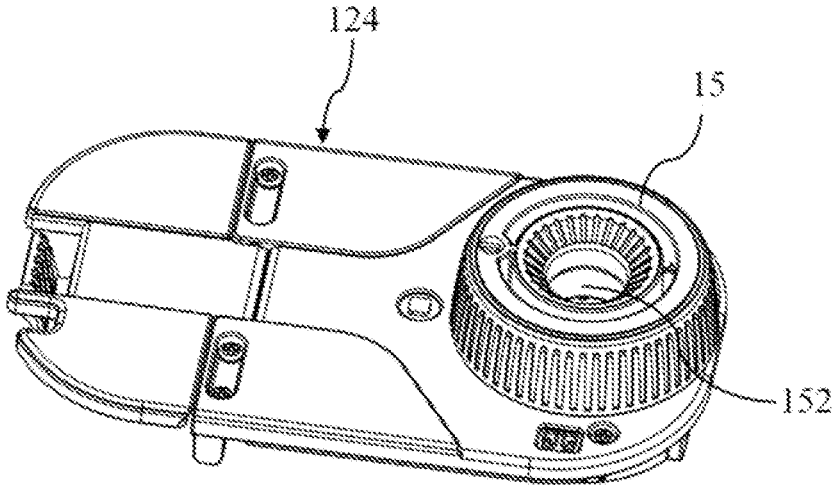
FIG. 7*a* is a schematic diagram of mounting an operating switch according to an example embodiment.
Figure 7B:
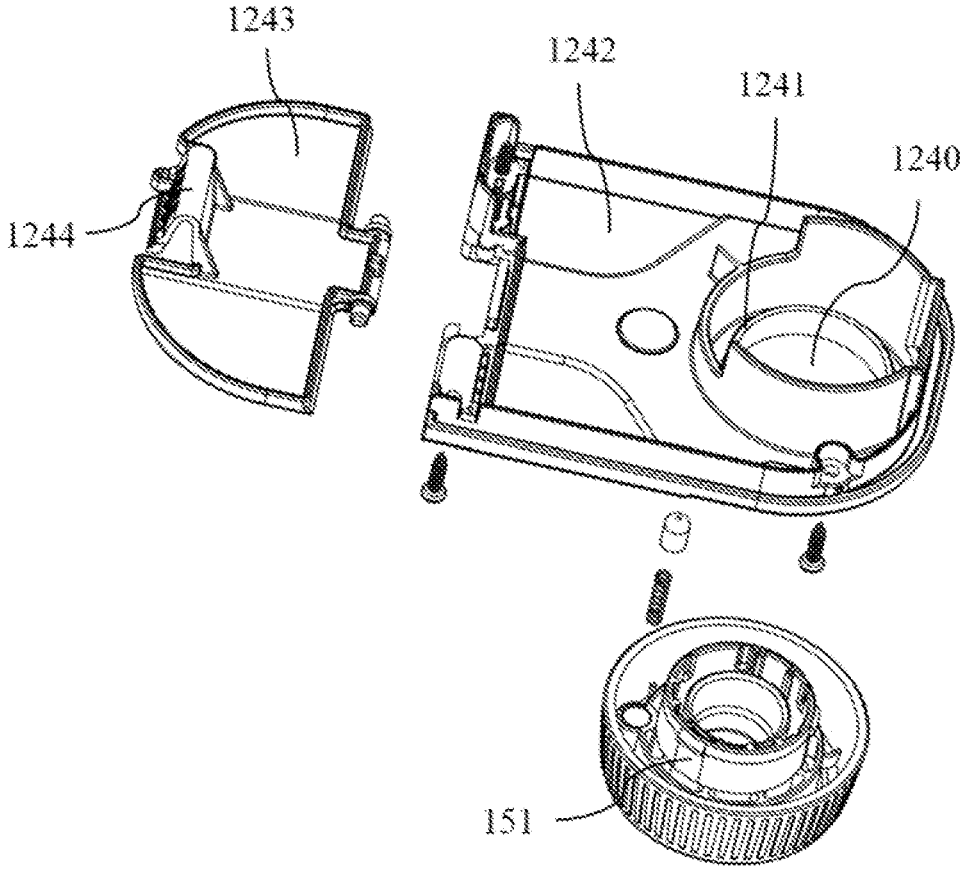
FIG. 7*b* is a schematic exploded view of FIG. 7*a* from another perspective.

As shown in FIGS. 7*a* and 7*b*, the operating switch 15 may be directly mounted on the panel 124 of the pump housing 12 by means of snap-fit. As an example, the panel 124 is provided with a mounting hole 1240, the operating switch 15 is provided with at least one hook 151, and the panel 124 is provided with a catch edge 1241 corresponding to the hook 151. The hook 151 is elastically engaged with the catch edge 1241 to mount the operating switch 15 on the panel 124. The operating switch 15 may be further provided with a vent 152 in communication with the mounting hole 1240. Through the vent 152, the interior of the built-in electric air pump 10 is in communication with an external airflow on the side of the panel 124.

Figure 8A:
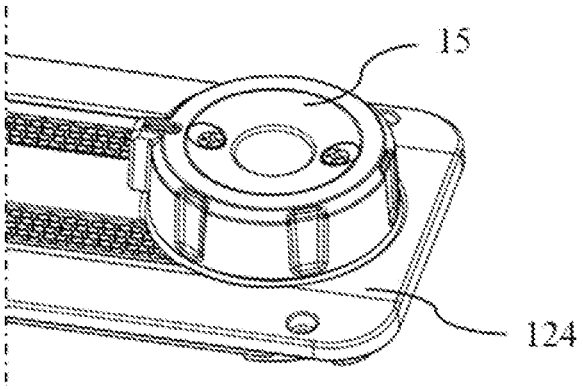
FIG. 8*a* is a schematic diagram of mounting an operating switch according to another example embodiment.
Figure 8B:
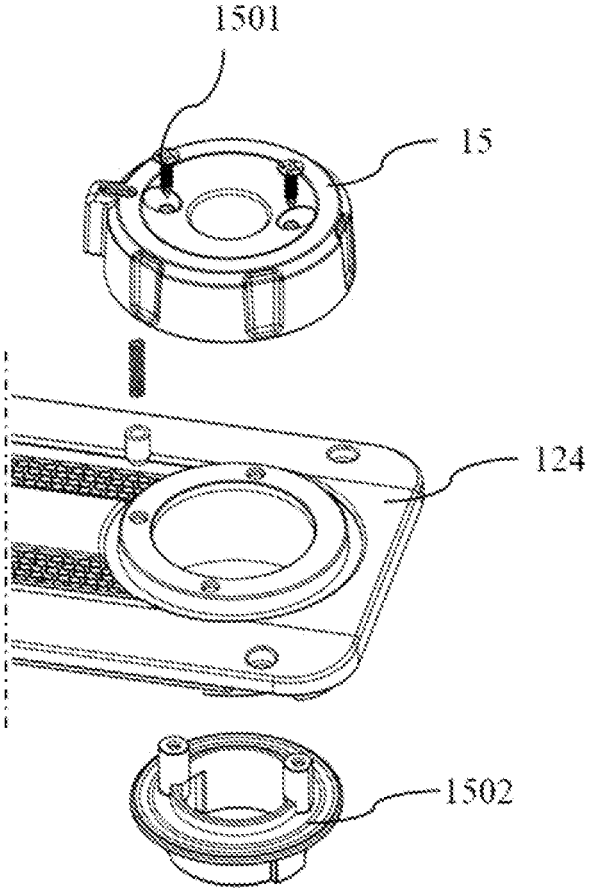
FIG. 8*b* is a schematic exploded view corresponding to FIG. 8*a;*

One or more example embodiments may further comprise, but are limited to, a manner in which the operating switch 15 is connected to the pump housing 12 by a threaded fastener. As shown in FIGS. 8*a* and 8*b*, the operating switch 15, may be fixed on one side of the panel 124 by screws 1501, and an assembly part 1502 configured for assembling the operating switch 15 may be provided on the other side of the panel 124. The operating switch 15 is provided with screw holes. The assembly part 1502 is provided with screw posts corresponding to the screw holes. The operating switch 15 and the assembly part 1502 are tightened together by the screws 1501 with the panel 124 sandwiched therebetween, thus the assembly of the operating switch 15 is completed. Compared with the foregoing manner in which the operating switch 15 is assembled by a threaded fastener, when the operating switch 15 is mounted on the panel 124 of the pump housing 12 by means of snap-fit, the number of components to be assembled may be greatly reduced, thereby simplifying the assembly procedures and reducing the cost.

Figure 9A:
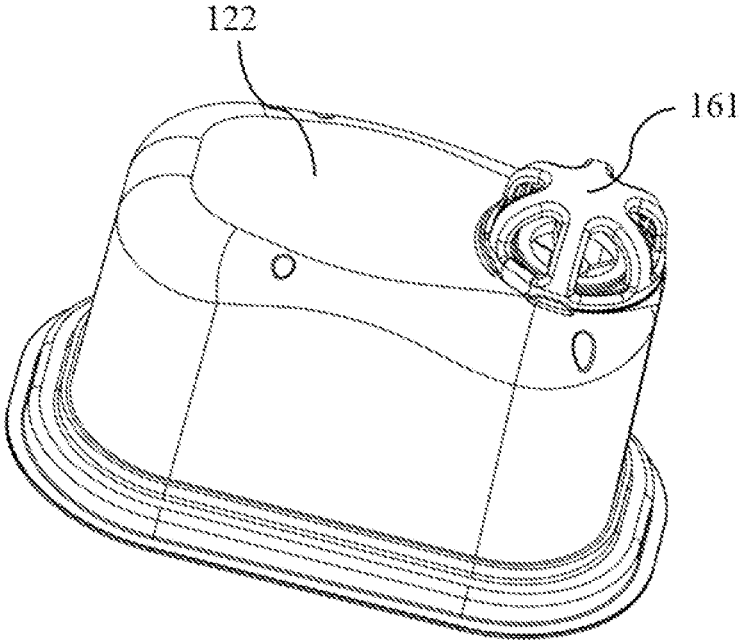
FIG. 9*a* is a schematic diagram of mounting a valve cover of an air valve according to an example embodiment.
Figure 9B:
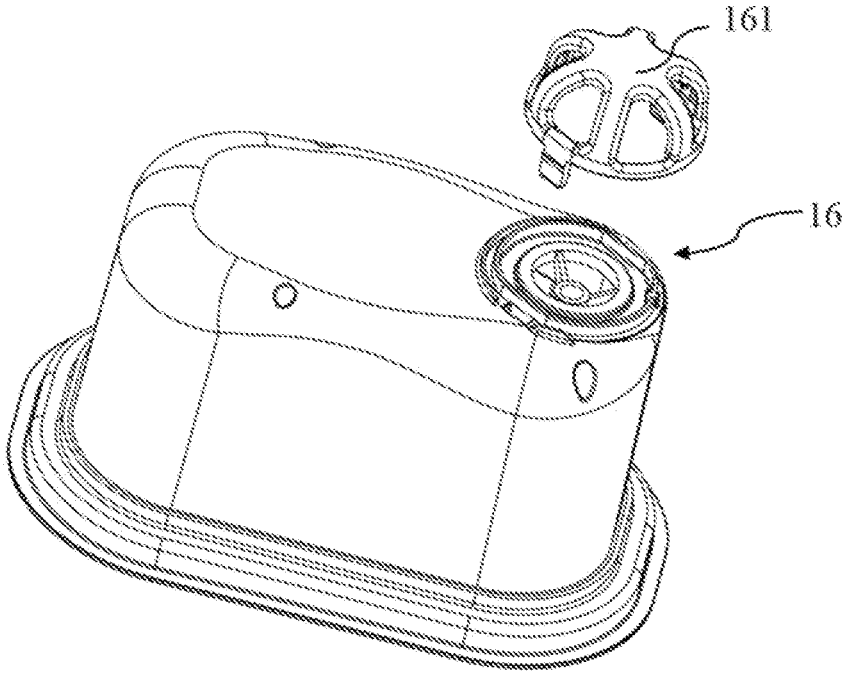
FIG. 9*b* is a schematic exploded view of FIG. 9*a;*

According to one or more example embodiments, as shown in FIGS. 9*a* and 9*b*, the air valve 16 is optionally configured with a valve cover 161. The valve cover 161 is configured for protecting the air valve 16 and preventing a chamber wall of the inflatable body or a part (for example, a tensioning band) inside the inflatable body from being sucked into the air valve. The valve cover 161 may be separately mounted on the pump housing 12. The valve cover 161 may be mounted on the pump housing 12 by means of snap-fit. For example, the air valve 16 may be mounted at the bottom of the shell 122 of the pump housing 12 opposite to the panel 124. The valve cover 161 is provided with at least one hook. The shell 122 is provided with a catch groove corresponding to the hook. The valve cover 161 may be directly inserted into the catch groove to implement the mounting of the valve cover 161 without a threaded fastener such as a screw or a bolt, so that the cost of the product may be reduced and the assembly of the product may be simplified. The valve cover 161 in the foregoing embodiment is arranged to protrude from the bottom of the shell 122. Alternately, according to one or more example embodiments, the valve cover may be generally flush with the bottom of the shell 122. One or more example embodiments may further comprise, but are not limited to, a manner in which the valve cover 161 is connected to the pump housing 12 by a threaded fastener.

According to one or more example embodiments, the press-fit element comprises at least one of a press plate and a press rod. Referring to the schematic exploded view in FIG. 10, for example, the press-fit element 18 is a press plate. With reference to FIGS. 3 and 4, the press plate divides the accommodating cavity 120 into a first chamber 1201 and a second chamber 1202 independent of the first chamber. The first chamber 1201 is configured to accommodate the driving device (at least comprising the motor 191) and the switching device 17, and the second chamber 1202 is configured to accommodate an external power cable (including at least a plug 201). The press-fit element 18, configured as a press plate, is provided with a wiring groove 181. The wiring groove 181 allows the external power cable to be connected to the motor 191 of the driving device. The second chamber 1202 is configured to receive the external power cable to implement the portable cable-receiving function of the built-in electric air pump 10, and such a cable-receiving manner does not affect the internal components of the built-in electric air pump 10.

Figure 10:
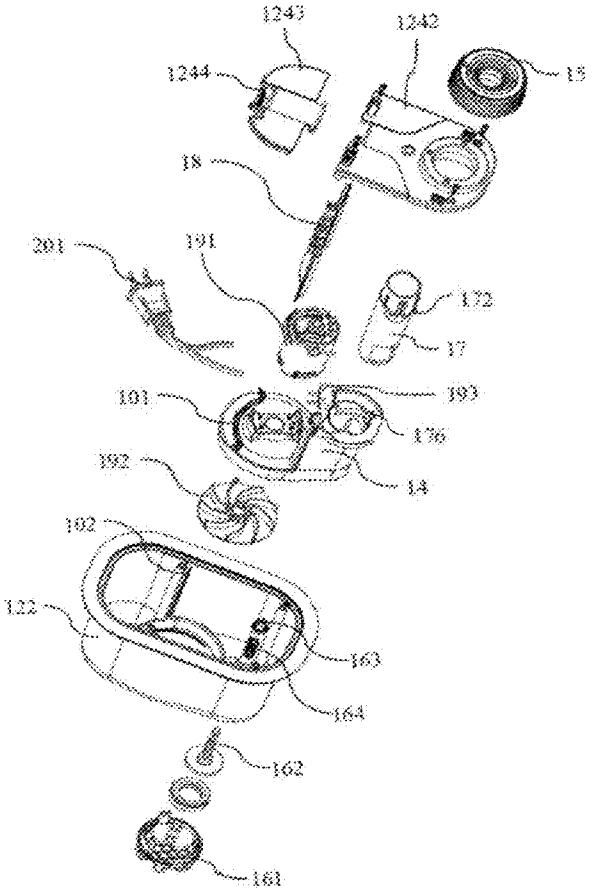
FIG. 10 is a schematic exploded view of the built-in electric air pump of FIG. 2.

Corresponding to the foregoing manner of receiving a power cable, referring to FIGS. 7*b* and 10, the panel 124 of the pump housing 12 comprises a panel body 1242 corresponding to the first chamber 1201 and a flip cover 1243 corresponding to the second chamber 1202. The flip cover 1243 is pivotably connected to the panel body 1242, and the flip cover 1243 is provided with a buckle element 1244 for engaging with the shell 122 of the pump housing 12. With such an arrangement, the receiving of the external power cable may be implemented by opening the flip cover 1243.

According to one or more example embodiments the built-in electric air pump 10 may be provided with a built-in power source such as a rechargeable battery. The pump housing 12 is provided with a charging interface. With such an arrangement, the built-in electric air pump 10 can be powered by the built-in power source alone. In the case of an external power source being unavailable or not readily available, the user may conveniently use the built-in electric air pump 10. Optionally, the built-in electric air pump 10 may have double power supply modes comprising built-in power supply and external power supply.

In other words, the second chamber 1202 for receiving a power cable is optional. Accordingly, the flip cover for receiving a power cable on the panel 124 of the pump housing 12 is also optional.

The press-fit element 18 optionally comprises at least one press rod in the form of an elongated rod. One end of the press rod presses against the pump cover 14, and the other end is tightly abutted against the panel 124 of the pump housing 12, to prevent the press-fit element 18 from displacing or moving vertically in the accommodating cavity 120.

For the press-fit element 18 configured as a press plate, referring to FIG. 10, a second limiting structure 102 is provided on an inner wall of the shell 122 of the pump housing 12, and the press plate has a lateral side in contact with the second limiting structure 102, so that the second limiting structure 102 limits a position of the press plate in the accommodating cavity 120. Optionally, the second limiting structure 102 may be configured as an insertion groove.

The lateral side of the press plate enters the accommodating cavity 120 along the insertion groove and presses against the pump cover 14. The second limiting structure 102 and the first limiting structure 101 configured as a curved positioning groove provide positioning and may also be combined with the panel 124 of the pump housing 12 to further provide air tightness, so that the first chamber 1201 and the second chamber 1202 are substantially independent of each other in terms of air tightness.

Referring to FIGS. 3 and 6, the driving device further comprises a micro switch 193. The switching cover 141 of the pump cover 14 is provided with a switch positioning post 1411 and a switch buckle 1412. The micro switch 193 is engaged with the switch positioning post 1411. The switch buckle 1412 retains the engagement between the micro switch 193 and the switch positioning post 1411. Specifically, the micro switch 193 is provided with an engaging hole matching with the switch positioning post 1411. Further, the panel 124 of the pump housing 12 abuts against the micro switch 193 to ensure that the micro switch 193 does not become loose. It should be understood that the micro switch 193 cooperates with a protrusion 171, at a corresponding position on the switching device 17, to control the ON and OFF of the motor 191.

Example operations of the built-in electric air pump 10 are described below in detail.

It may be understood according to the foregoing description that the switching device 17 is configured to be driven by the operating switch 15 to switch at least between the first position and the second position. More specifically, the switching device 17 is accommodated in the switching cover 141 of the pump cover 14. The switching device 17 has the first position and the second position relative to the switching cover 141.

Figure 12:
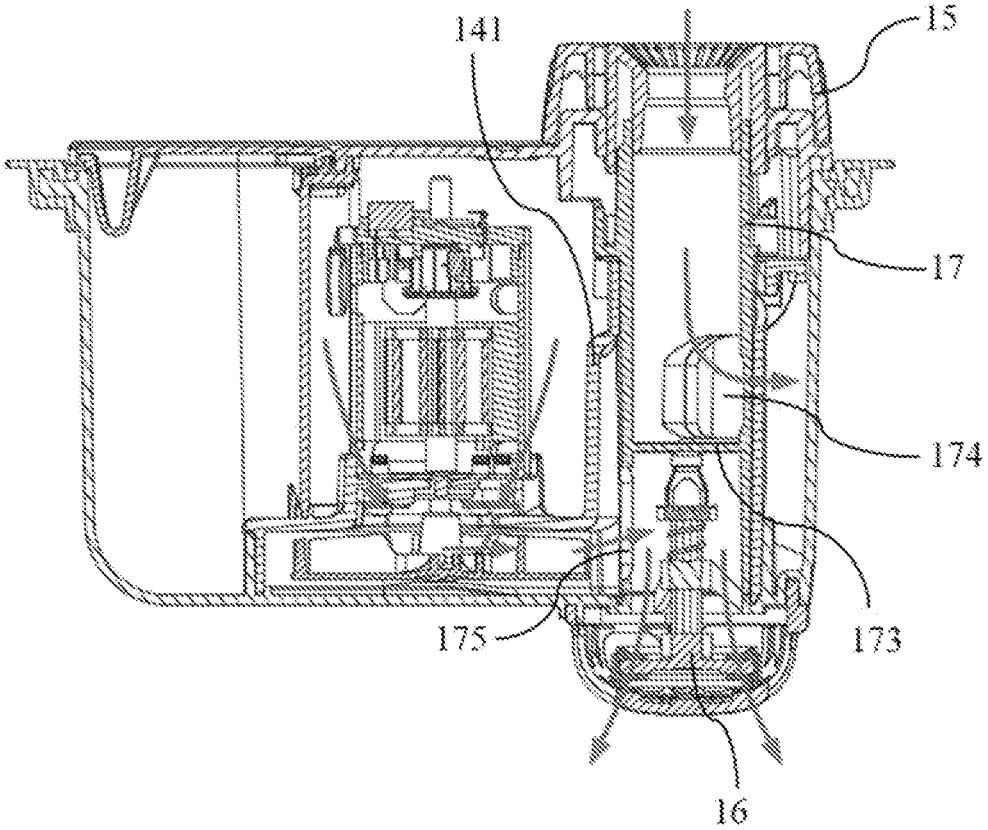
FIG. 12 is a schematic cross-sectional view of the built-in electric air pump in the inflation state of FIGS. 11*a* and 11*b;*
Figure 15:
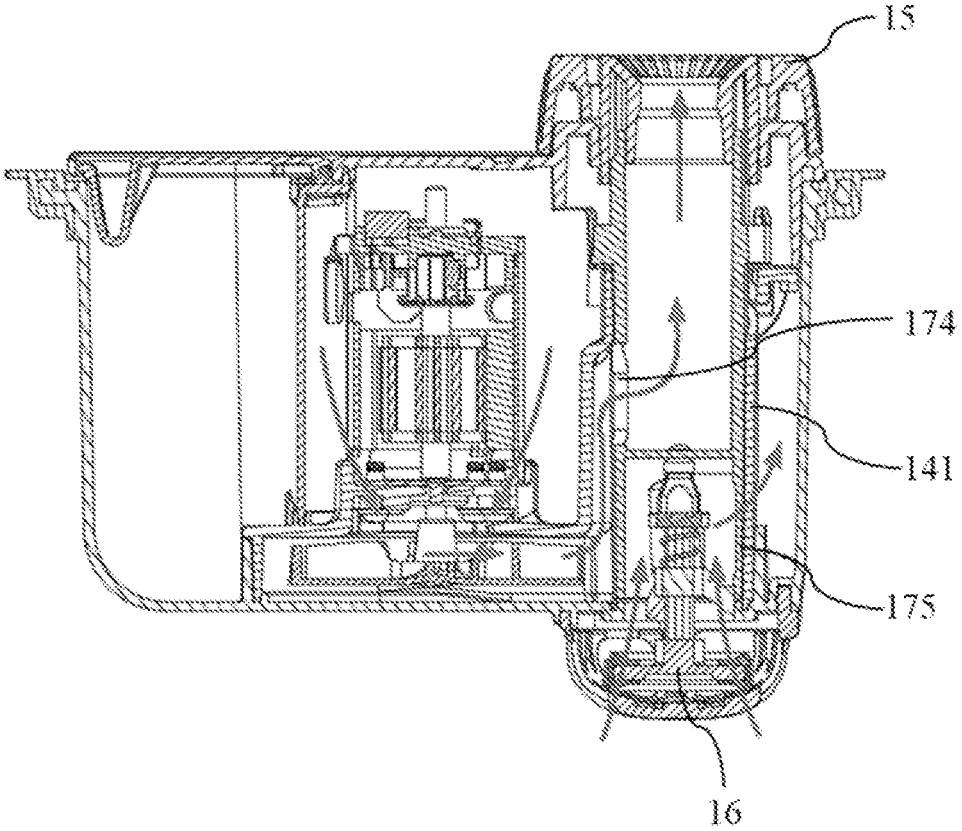
FIG. 15 is a schematic cross-sectional view of the built-in electric air pump in the exhaust state of FIGS. 14*a* and 14*b*.

The switching device 17 is configured to have an axis. The switching cover 141 of the pump cover 14 is configured to have an axis extending in parallel to the axis of the switching device 17. With reference to FIGS. 12 and 15, the operating switch 15 and the air valve 16 are arranged on opposite sides along the axial of the switching device 17. In a state in which the built-in electric air pump 10 is attached to the inflatable body 100, the operating switch 15 is accessible to the user from the outside of the inflatable body 100. In a state in which the built-in electric air pump 10 is in the inflation state, air enters the built-in electric air pump 10 through the vent 152 of the operating switch 15 and then enters the inflation chamber of the inflatable body 100 through the air valve 16. In a state in which the built-in electric air pump 10 is in the exhaust state, air in the inflation chamber of the inflatable body 100 enters the built-in electric air pump 10 through the air valve 16 and is exhausted to the external atmospheric environment through the vent 152 of the operating switch 15.

Specifically, a surface of one of the pump cover 14 (particularly the switching cover 141 of the pump cover 14) and the switching device 17 may be provided with a guide groove 176. A guide block is provided on the other of the pump cover 14 and the switching device 17. The guide groove 176 is disposed obliquely relative to the axis of the switching device 17. When the switching device 17 rotates around the axis thereof, the guide block slides along the guide groove 176 to force the switching device 17 to move in the pump cover 14 in an axial direction of the switching device 17. Referring to the example embodiment shown in FIG. 6, a surface of the switching cover 141 of the pump cover 14 is provided with a guide groove 176. The guide groove 176 comprises an inlet end 1413 and angled grooves 1414 disposed on two sides of the inlet end 1413. An angled groove 1414 on one side extends obliquely clockwise from the inlet end 1413, and the angled groove 1414 on the other side extends obliquely counterclockwise from the inlet end 1413. The switching device 17 is provided with a guide block 172. The guide block 172 enters the guide groove 176 from the inlet end 1413 of the guide groove 176. When the switching device 17 is driven by the operating switch 15 to rotate around the axis of the switching device, the guide block 172 selectively enters the angled groove 1414 on one side and slides along the angled groove 1414 on this side, so that the operating switch 15 forces the switching device 17 to move in the pump cover 14 in the axial direction of the switching device 17.

According to one or more example embodiments, as shown in FIG. 10, because the angled grooves 1414 on two sides both extend along the axis of the switching device 17 (or along the axis of the switching cover 141) from the inlet end 1413 toward the bottom of the switching cover 141, the switching device 17 always moves axially toward the air valve 16 in the switching cover 141, regardless of the clockwise or counterclockwise rotation of the switching device 17 around the axis of the switching device.

Figure 11A:
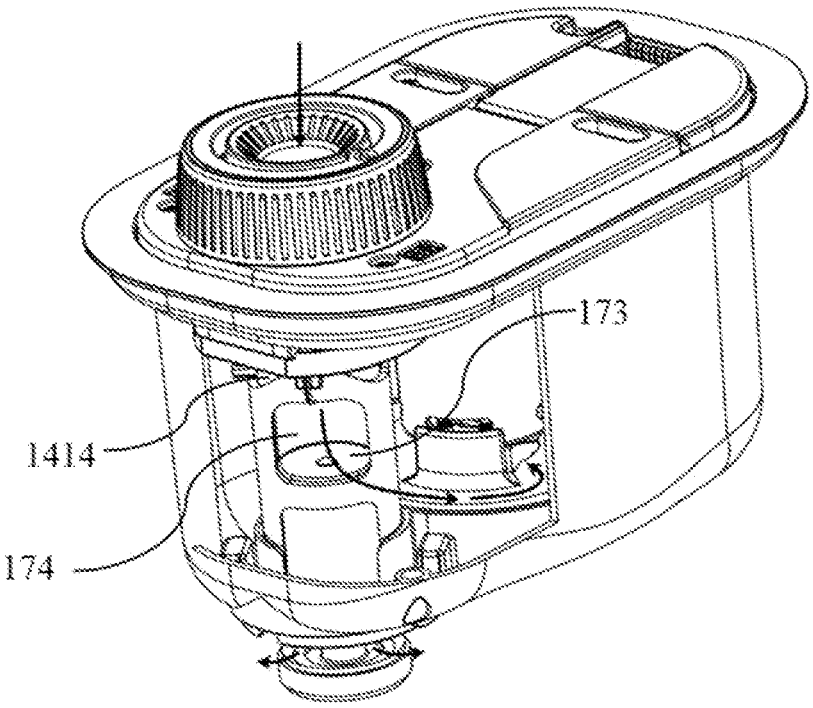
FIG. 11*a* is a schematic perspective diagram of an inflation path of a built-in electric air pump in an inflation state, with part of a pump housing hidden.
Figure 11B:
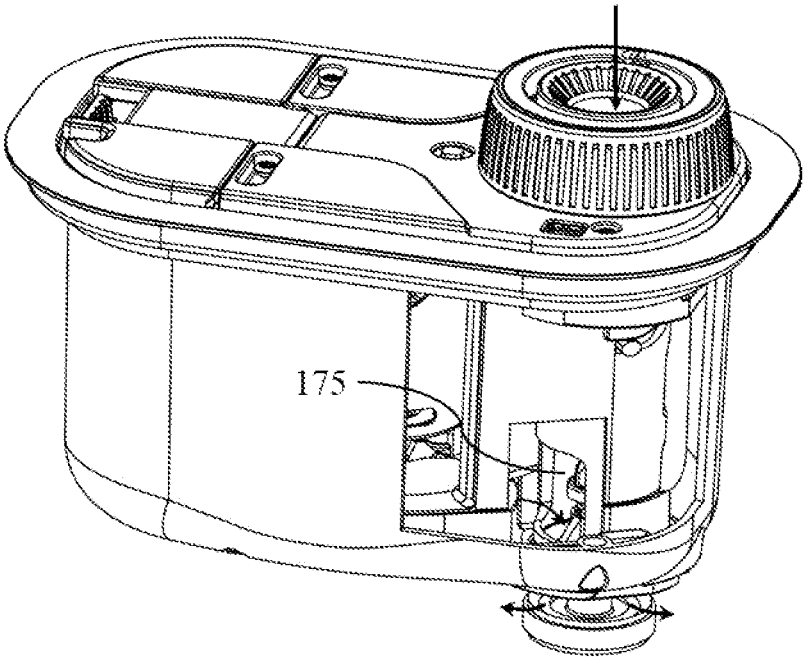
FIG. 11*b* is a schematic perspective diagram of the inflation path of the built-in electric air pump in the inflation state, with part of the pump housing being hidden.

Specifically, as shown in FIG. 10, the air valve 16 further comprises a valve stem 162, a valve head 163, and a return spring 164 sleeved on the valve stem 162. The valve head 163 is disposed at an end of the valve stem 162. One end of the return spring 164 abuts against the pump housing 12, and the other end of the return spring 164 abuts against the valve head 163. As shown with respect to FIG. 12, the switching device 17 is provided with a pusher 173. The pusher 173 is configured as a partition plate in the switching device 17 for blocking the axial flow of an airflow in the switching device 17. Further, with reference to FIGS. 11*a* and 11*b*, a surface of the switching device 17 is provided with an upper opening 174 and a lower opening 175, the upper opening 174 and the lower opening 175 being separated by the pusher 173. The airflow forms an airflow path from the upper opening 174 to the lower opening 175. Further, the pusher 173 is configured to be in contact with the valve head 163 of the air valve 16 so as to apply a force to the valve head 163 to drive the air valve 16 to be opened or closed.

Referring to FIG. 12, the operating switch 15 is rotated in a first direction (one of a clockwise direction or a counterclockwise direction) to drive the switching device 17 to move downward, based on the orientation shown in the figures, in the axial direction of the switching cover 141, to reach the first position of the switching device 17 as shown in FIG. 12. During the foregoing movement, the pusher 173 applies a force to the valve head 163 to drive the air valve 16 to be opened, so that the built-in electric air pump 10 is in the inflation state. In the inflation state, the switching cover 141 of the pump cover 14 is provided with a first opening at the first position of the switching device 17. The first opening comprises a pair of openings that are respectively aligned with the upper opening 174 and the lower opening 175 to allow the passage of an airflow, so as to form an inflation path from the upper opening 174 to the lower opening 175. Specifically, as the pusher 173 drives the air valve 16 to be opened, the airflow enters the interior of the switching device 17 through the vent 152 of the operating switch 15. Subsequently, the airflow reaches the first chamber 1201 from the interior of the switching device 17 through the upper opening 174. In the first chamber 1201, under the action of the impeller 192, the airflow reaches, through the through hole 190, the side on which the impeller 192 is located. Based on the foregoing description, since the switching cover 141 and the impeller cover 142 of the pump cover 14 are in fluid communication, under the action of the impeller 192, the airflow further flows to the switching cover 141 from the impeller cover 142, and returns to the interior of the switching device 17 through the lower opening 175 in the switching cover 141. The airflow finally enters the inflation chamber of the inflatable body 100 through the valve cover 161 of the air valve 16.

Figure 14A:
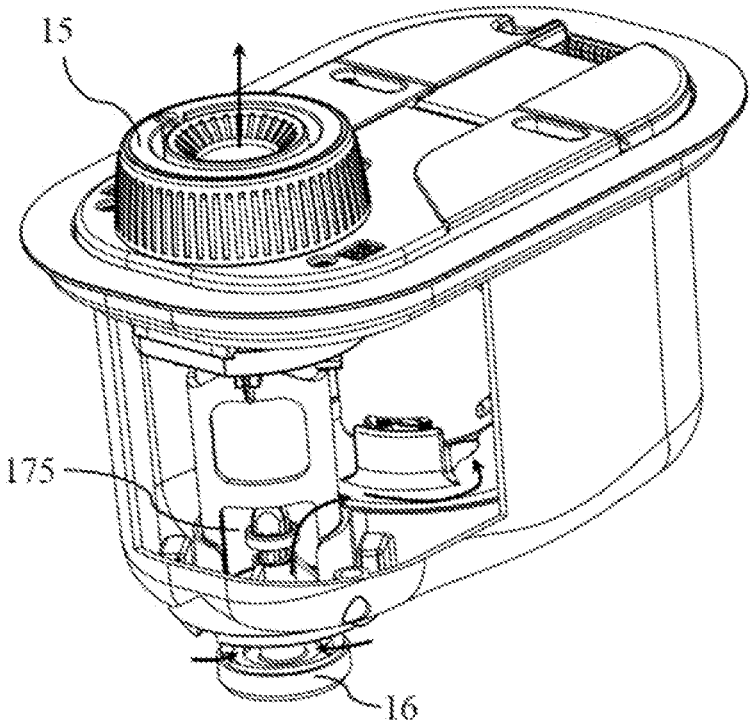
FIG. 14*a* is a schematic perspective diagram of an exhaust path of a built-in electric air pump in the exhaust state, with part of a pump housing hidden.
Figure 14B:
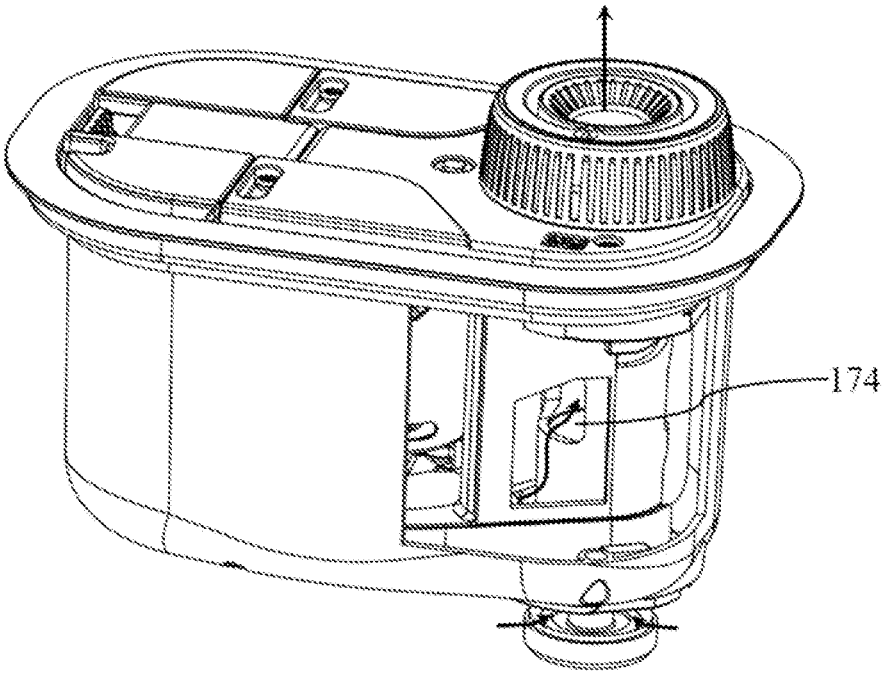
FIG. 14*b* is a schematic perspective diagram of the exhaust path of the built-in electric air pump in the exhaust state, with part of the pump housing hidden.

Referring to FIGS. 14*a* to 15, the operating switch 15 is rotated in a second direction (the other of the clockwise direction or the counterclockwise direction) to drive the switching device 17 to move downward as shown by the arrow in the figures in the axial direction of the switching cover 141 to reach the second position of the switching device 17 as shown in FIGS. 14*a* to 15. During the foregoing movement, the pusher 173 applies a force to the valve head 163 to drive the air valve 16 to be opened, so that the built-in electric air pump 10 is in the exhaust state. In the exhaust state, the switching cover 141 of the pump cover 14 is provided with a second opening at the second position of the switching device 17. The second opening comprises a pair of openings that are respectively aligned with the upper opening 174 and the lower opening 175 to allow the passage of an airflow, so as to form an exhaust path from the lower opening 175 to the upper opening 174. Specifically, as the pusher 173 drives the air valve 16 to be opened, the airflow enters the interior of the switching device 17 from the inflation chamber of the inflatable body 100 through the valve cover 161 of the air valve 16. Subsequently, the airflow reaches the first chamber 1201 from the interior of the switching device 17 through the lower opening 175. In the first chamber 1201, under the action of the impeller 192, the airflow reaches, through the through hole 190, the side on which the impeller 192 is located. Under the action of the impeller 192, the airflow further flows to the switching cover 141 from the impeller cover 142, and returns to the interior of the switching device 17 through the lower opening 174 in the switching cover 141. The airflow finally is exhausted to the external atmospheric environment through the vent 152 of the operating switch 15.

Figure 13:
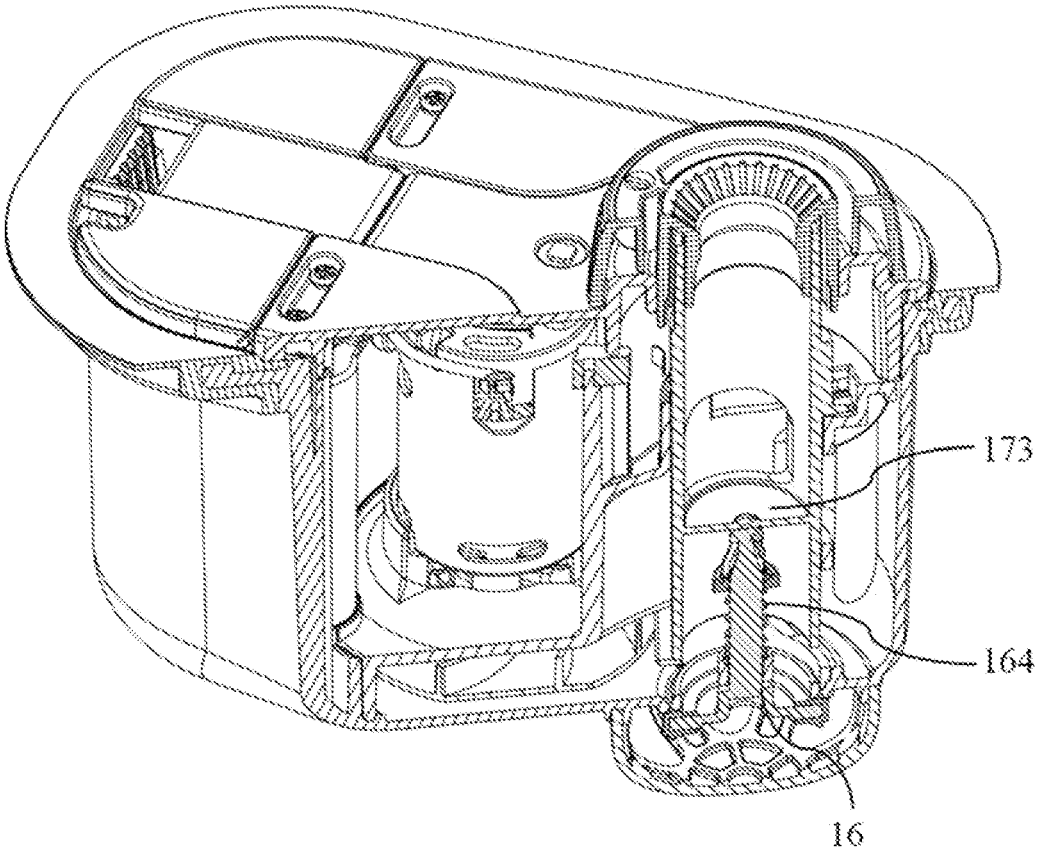
FIG. 13 is a schematic cross-sectional view of a built-in electric air pump in a deactivated state (an air valve is closed)

According to one or more example embodiments, the switching device 17 may have an additional third position. As shown in FIG. 13, when the switching device 17 is in the third position, the air valve 16 is closed, and the motor 191 stops operating, that is, the built-in electric air pump 10 is in a stopped state. As the switching device 17 moves to the third position in the axial direction of the switching cover 141, the return spring 164 of the air valve 16 drives the air valve 16 to be closed, during which the return spring 164 releases the elastic potential energy stored therein when the switching device 17 is switched to the first position or the second position.

When the switching device 17 is in the third position, the upper opening 174 and the lower opening 175 of the switching device 17 are blocked by the switching cover 141 of the pump cover 14, so as to further function to block the airflow.

According to the foregoing description, each of the inflation path shown in FIG. 12 and the exhaust path shown in FIG. 15 comprises a flow path for conveying the airflow from the impeller 192 to the switching cover 141.

Accordingly, one or more example embodiments may provide a built-in electric air pump for which assembly procedures may be simplified. For both internal components and external components, the number of fasteners such as threaded connectors may be reduced, so that the production efficiency is improved, thereby reducing the production cost of the built-in electric air pump. In addition, a space for mounting fasteners is not required, so that the size and weight of the built-in electric air pump may be reduced.

According to the above teachings, many modifications and variations are feasible, and can be implemented otherwise than as specifically described within the scope of the appended claims.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. A built-in electric air pump adapted to be attached to an inflatable body, the built-in electric air pump comprising:

a pump housing defining therewithin an accommodating cavity;

a pump cover disposed within the accommodating cavity;

an impeller disposed on a first side of the pump cover;

a switching device disposed within the accommodating cavity;

an air valve in fluid communication with the switching device; and an operating switch operably connected to the switching device and configured to drive the switching device to switch between a first position in which the built-in electric air pump is in an inflation state and a second position in which the built-in electric air pump is in an exhaust state; and a press plate disposed within the accommodating cavity and comprising a first end biased to press against a first limiting structure of the pump cover, and a second end biased to press against the pump housing, such that the press plate and the pump housing limit a position of the pump cover within the accommodating cavity;

wherein the press plate divides the accommodating cavity into a first chamber and a second chamber independent of each other, wherein a driving device and the switching device are accommodated within the first chamber, and the second chamber is configured to accommodate an external power cable therewithin.

2. The built-in electric air pump according to claim 1, further comprising:

a motor disposed on a second side of the pump cover, opposite the first side, the motor configured to drive the impeller;

wherein the pump cover comprises an impeller cover, and the impeller is disposed in the first chamber defined by the pump housing and by the impeller cover.

3. The built-in electric air pump according to claim 2, wherein the air valve comprises a valve cover mounted on the pump housing by means of snap-fit.

4. The built-in electric air pump according to claim 2, wherein the pump cover is disposed at a bottom of the pump housing.

5. The built-in electric air pump according to claim 1 wherein the pump cover comprises:

a switching cover and an impeller cover in fluid communication with the switching cover, wherein the switching device is accommodated within the switching cover, the impeller is accommodated within the impeller cover, and the first limiting structure is disposed on the impeller cover.

6. The built-in electric air pump according to claim 1, wherein the first limiting structure is shaped to fit the first end of the press plate.

7. The built-in electric air pump according to claim 1, wherein:

the pump cover comprises a motor positioning post configured to engage the motor, and the press plate comprises a pressing portion corresponding to the motor and biased to press the motor against the pump cover.

8. The built-in electric air pump according to claim 1, wherein the operating switch is mounted on the pump housing by means of snap-fit.

9. The built-in electric air pump according to claim 1, wherein the press plate comprises a wiring groove configured to enable the external power cable to be connected to the driving device.

10. The built-in electric air pump according to claim 1, wherein the pump housing comprises a shell having an opening therein and a panel configured to close the opening in the shell such that the shell and the panel together define the accommodating cavity; and the panel comprises a panel body corresponding to the first chamber, and a flip cover corresponding to the second chamber, wherein the flip cover is pivotably attached to the panel body and comprises a buckle element configured to engage with the shell.

11. The built-in electric air pump according to claim 10, wherein the shell further comprises a second limiting structure that is provided on an inner wall thereof and being in contact with a lateral side of the press plate, such that the second limiting structure limits a position of the press plate within the accommodating cavity.

12. The built-in electric air pump according to claim 1, wherein:

the driving device further comprises a micro switch, and the pump cover further comprises a switch positioning post and a switch buckle, wherein the micro switch is engaged with the switch positioning post, and the switch buckle is configured to retain an engagement between the micro switch and the switch positioning post.

13. The built-in electric air pump according to claim 1, wherein:

when the switching device is in one of the first position and the second position, the switching device drives the air valve to be opened; and when the switching device is in a third position, the air valve is closed.

14. The built-in electric air pump according to claim 13, further comprising:

a switching cover accommodating the switching device therein;

wherein the air valve comprises:

a valve stem, a valve head disposed on an end of the valve stem, and a return spring comprising a first end which abuts against the pump housing and a second end which abuts against the valve head, wherein the switching device comprises a pusher;

wherein when the switching device moves in an axial direction of the switching cover to one of the first position and the second position, the pusher applies a force to the valve head to drive the air valve to be opened; and when the switching device moves in the axial direction of the switching cover to the third position, the return spring drives the air valve to be closed.

15. The built-in electric air pump according to claim 14, wherein the switching device comprises, formed in a wall surface thereof, an upper opening and a lower opening which are separated by the pusher;

the pump cover comprises:

an inflation path formed between the upper opening and the lower opening;

an exhaust path formed between the lower opening and the upper opening; and when the switching device is in the third position, the upper opening and the lower opening are blocked by the pump cover.

* * * * *